US008147747B2

(12) United States Patent
Wang et al.

(10) Patent No.: US 8,147,747 B2
(45) Date of Patent: Apr. 3, 2012

(54) SWIRLING COLUMN NOZZLE, SWIRLING COLUMN SMELTING EQUIPMENT USING THE SAME, AND SWIRLING COLUMN SMELTING METHOD

(75) Inventors: Jikun Wang, Kunming (CN); Wenhai Zhang, Jiangxi (CN); Ying Dong, Kunming (CN); Xiaobo Zhang, Jiangxi (CN)

(73) Assignees: Yunnan Metallurgical Group Co., Ltd., Kunming, Yunnan Province (CN); China Nerin Engineering Co., Ltd., Nanchang, Jiangxi (CN)

( * ) Notice: Subject to any disclaimer, the term of this patent is extended or adjusted under 35 U.S.C. 154(b) by 288 days.

(21) Appl. No.: 12/361,062

(22) Filed: Jan. 28, 2009

(65) Prior Publication Data

US 2010/0107821 A1 May 6, 2010

(30) Foreign Application Priority Data

Nov. 4, 2008 (CN) ..... 2008 1 0225530

(51) Int. Cl.
*C21C 5/48* (2006.01)

(52) U.S. Cl. ..... 266/222; 266/268; 110/182.5

(58) Field of Classification Search ..... 266/217–226, 266/265–268; 110/182.5
See application file for complete search history.

(56) References Cited

U.S. PATENT DOCUMENTS 3,567,202 A * 3/1971 Mercatoris et al. ..... 239/132.3
6,322,610 B1 * 11/2001 Pavlicevic et al. ..... 75/554
6,436,169 B2 * 8/2002 Hirai et al. ..... 75/640
6,755,890 B1 * 6/2004 Hanniala et al. ..... 75/640
7,611,563 B2 * 11/2009 Memoli et al. ..... 75/530
7,837,928 B2 * 11/2010 Harrison et al. ..... 266/267

* cited by examiner

*Primary Examiner* — George Wyszomierski
*Assistant Examiner* — Tima M McGuthry Banks
(74) *Attorney, Agent, or Firm* — Kile Goekjian Reed & McManus PLLC

(57) ABSTRACT

A swirling column nozzle comprises a nozzle body with an air chamber defined therein; an outlet portion, a feed pipe penetrating through the air chamber and extending to the outlet portion, an oxygen supplying portion disposed on the nozzle body, the outlet portion is formed with a swirling guide part for moving a mixture of the oxygen gas and the concentrate downwardly in the form of a swirling column. Further, a swirling column smelting equipment and a method thereof are disclosed. The air flow moves downwardly in a substantially swirling column, so the chemical reaction path and reaction time are extended remarkably, allowing the reduction of the height of the reaction shaft.

15 Claims, 3 Drawing Sheets

SWIRLING COLUMN NOZZLE, SWIRLING COLUMN SMELTING EQUIPMENT USING THE SAME, AND SWIRLING COLUMN SMELTING METHOD

CROSS-REFERENCE TO RELATED APPLICATIONS

This application claims the priority of China Patent Application No. 200810225530.0 filed on Nov. 4, 2008, in the China Intellectual Property Office, the disclosure of which is incorporated herein in its entirety by reference.

BACKGROUND OF THE INVENTION

1. Field of the Invention

The present invention relates, generally, to a technology of nonferrous metallurgy, and more particularly, to a swirling column nozzle, a swirling column smelting equipment and a swirling column smelting method.

2. Description of the Related Art

Lead is an important fundamental industrial raw material. In a conventional lead smelting process, i.e. "sintering-blast furnace method", the lead sulfide concentrate has to be sintered in a separate sintering workshop. Meanwhile, to obtain suitable sintered briquette, a large amount of sintered concentrate has to be returned, which decreases production efficiency of lead smelting. Further, during sintering process of forming sintered briquette by desulfurization, the $SO_2$ content in the sintering flue gases is relatively low, and there is difficulty in recovering sulfur. In addition, blast furnace smelting needs expensive smelter coke, which increases cost for producing pig lead. Therefore, the conventional sintering-blast furnace method may bring serious pollution to environment and consume large amount of energy.

To improve the conventional sintering-blast furnace method, Lurgi Company, Germany, developed a novel process, i.e. Queneau-Schuhmann-Lurgi process (Q.S.L. method) for direct lead smelting in 1970s. Presently, the Q.S.L. method is adopted by Stolberg smelting plant, Germany, and Onsan smelting plant for lead production. And it is characteristic of Q.S.L. method that the size of equipment needed is relatively small and pig lead can be directly obtained. However, the dust rate thereof is relatively high which may reach 20%. Further, the lead content in the furnace slag processed by Q.S.L. method is relatively high. Therefore, the production effect of the Q.S.L. method is not satisfactory.

In 1980s, nonferrous metal research institute of Soviet Union developed a direct lead smelting process, i.e., Kivcet method. The method has been industrialized by many plants, which is a novel lead smelting process with advanced indexes and high reliability. However, the Kivcet method has following disadvantages: the reaction furnace has a tetragonal shape with huge size and high producing cost. Further, electrodes have to be provided in the reaction furnace for reduction reaction, and the electrodes consume huge amounts of power. Still further, the Kivcet method has a large investment per product unit.

In addition, in the conventional lead smelting technologies, to obtain lead recovery rate which is sufficiently high, the slag produced after reaction in the furnace normally needs secondary slag cleaning, which means additional processing equipment. Thus, the processing cost thereof is increased and process complexity is increased accordingly.

SUMMARY OF THE INVENTION

An object of the invention is to provide a lead smelting equipment and a method thereof, which may reduce production cost, increase pig lead yield and may greatly reduce maintenance cost of the equipment.

Another object of the present invention is to provide a lead smelting equipment and a method thereof which may reduce power consumption. A further object of the present invention is to provide a lead smelting equipment and a method thereof which may reduce environmental pollution and may be environmentally friendly.

A still further object of the present invention is to provide a lead smelting equipment and a method thereof, which may not only produce lead but also achieve lead recovery in furnace slag, enhancing lead recovering rate, reducing cost and simplifying the production process.

A still yet further object of the present invention is to provide a swirling column nozzle, so that a mixture of lead concentrate and oxygen gas may be transferred into the smelting equipment in a swirling manner by the nozzle to sufficiently mix the lead concentrate and the oxygen gas, thus may enhancing production yield of smelting.

Accordingly, an example embodiment of the present invention provides a swirling column nozzle, comprising a nozzle body with an air chamber defined therein, an outlet portion connected to a lower end of the nozzle body, a feed pipe penetrating through the air chamber and extending to the outlet portion for supplying concentrate, an oxygen supplying portion disposed on the nozzle body for supplying oxygen into the air chamber, wherein a swirling guide part is formed in the outlet portion for moving a mixture of the oxygen gas and the concentrate downwardly in the form of a swirling column.

According to an aspect of the invention, the swirling guide part may comprise a plurality of guide ribs formed on an inner wall of the outlet portion, and each of the plurality of guide ribs has a predetermined inclination angle with respect to the central axis of the outlet portion.

According to another aspect of the invention, each guide rib may have a straight line shape or curved line shape in the longitudinal cross-section direction.

In the above aspects thereof, because the mixture of the concentrate, such as lead concentrate, and the oxygen gas moves downwardly in the form of a substantially swirling column, the chemical reaction path may be remarkably extended and, subsequently, the reaction time thereof may be remarkably extended accordingly.

According to a fourth aspect of the invention, the outlet portion may be separately or individually formed from the swirling column nozzle.

Thus, because the outlet portion can be separately formed, the outlet portion may be substituted directly without replacing the entire swirling column nozzle during usage if the outlet portion is damaged or the guide ribs have to be modified, thus reducing manufacturing cost and making the maintenance more convenient.

According to a fifth aspect of the invention, a swirling column smelting equipment is provided, comprising a reaction shaft, a swirling column nozzle as described above disposed on top of the reaction shaft, a settling bath disposed under the reaction shaft for receiving melts fallen after reacting in the reaction shaft, and at least one uptake shaft communicated with the reaction shaft and the settling bath for discharging flue gases in the reaction shaft.

As described above, because the mixture of the concentrate, such as lead concentrate, and the oxygen gas moves downwardly in the form of a swirling column, the chemical reaction path may be remarkably extended and, subsequently, the reaction time may be remarkably extended accordingly, thus a height of the reaction shaft necessary for the chemical reaction may be reduced. Thus, the heat dissipation loss thereof may be lowered and the pre-stage investment of the plant may be reduced accordingly.

In addition, because the mixture of the concentrate, such as lead concentrate, and the oxygen gas moves downwardly in the form of a substantially swirling column, the impact of the particles thereof to the side walls of the reaction shaft may be ameliorated, thus alleviating the severe erosion and scouring of the particles in the mixture of the concentrate and the oxygen gas to the inner walls of the reaction shaft. From above, the later maintenance cost may be reduced greatly.

According to a sixth aspect of the present invention, the swirling column smelting equipment further comprises a separator disposed in the settling bath for partitioning the settling bath into a first tank portion and a second tank portion which are communicated with each other via an opening formed at a lower part of the separator.

According to a seventh aspect of the present invention, the settling bath is further provided with a reductant supplying device for feeding reductant, such as carbon reductant, into the second tank portion.

According to an eighth aspect of the present invention, the settling bath is further provided with an oxidant supplying device for adding the oxidant into the second tank portion.

According to a ninth aspect of the present invention, the swirling column smelting equipment further comprises at least one reducing electrode inserted into the second tank portion of the settling bath.

According to a tenth aspect of the present invention, the swirling column smelting equipment may further comprises a sulfidizer supplying device for supplying sulfidizer to the reaction shaft and/or settling bath for reciprocal reaction therein.

Further, because the pig lead production from the lead concentrate and the de-leading treatment of the furnace slag are processed in the same swirling column smelting equipment, the whole process may be shortened with a more continuous operation, thus enhancing production yield. Further, the lead content of the furnace slag in conventional process may reach 10%, which need slag cleaning by transferring the slag to another electric furnace separately to reduce the lead content therein. However, in the example embodiments of present invention, because the melts are added with carbon reductant after the melts are stratified into a slag layer and a pig lead layer when falls in the swirling column smelting equipment, the carbon reductant reacts with the lead oxide in the slag layer, so that the lead content in the slag can be reduced to 5% or lower, thus saving cost and reducing process flow. In addition, the energy consumption of the whole process may be reduced on a large scale. After the reduction reaction of the slag in the settling bath, the slag may be discharged directly.

According to an eleventh aspect of the present invention, the reaction shaft, the settling bath and the passage are integrally formed.

Further, because the reaction shaft, the settling bath and the passage are integrally formed, the whole process are undertaken in a sealed environment, which may enhance safety of the manufacturing process and, further, decreases heat loss during the process.

Still Further, according to a twelfth aspect of the present invention, a swirling column smelting method of lead concentrate is provided, comprising: mixing dried lead concentrate and oxygen gas and eject mixture thereof into a reaction shaft in a form of a substantially swirling column; and moving the lead concentrate and the oxygen gas downwardly in the reaction shaft in the form of the substantially swirling column while reacting with each other to produce melts and flue gases therefrom.

Yet further, according to an thirteenth aspect of the present invention, the method further comprising: adding carbon reductant into the melts after the melts are stratified into a slag layer and a pig lead layer, so that there is reciprocal reaction between the carbon reductant and the residual lead oxide and lead sulfide in the slag layer.

Still yet further, according to an fourteenth aspect of the present invention, sulfidizer is fed after the melts are stratified into slag layer and pig lead layer, so that there is reciprocal reaction between the sulfidizer and the residual lead oxide in the slag layer.

From above, because the lead concentrate and oxygen gas are mixed to be ejected into the reaction shaft in the form of a substantially swirling column, the chemical reaction path and time thereof may be extended substantially, and, accordingly, the height of the reaction shaft necessary for the chemical reaction may be reduced substantially. Thus, the heat dissipation loss thereof may be lowered and the pre-stage investment of the plant may be reduced accordingly. In addition, the pig lead production from the lead concentrate and the de-leading treatment of the furnace slag are processed in the same swirling column smelting equipment by feeding carbon reductant therein, further, the whole process may be shortened with a more continuous operation, thus enhancing production yield. Further, the method may decrease energy consumption, save energy and substantially reduce pollution to the environment.

Other objects, features, and advantages of the present invention will be readily appreciated as the same becomes better understood while reading the subsequent description taken in conjunction with the accompanying drawings.

DETAILED DESCRIPTION OF THE INVENTION

Figure 1:
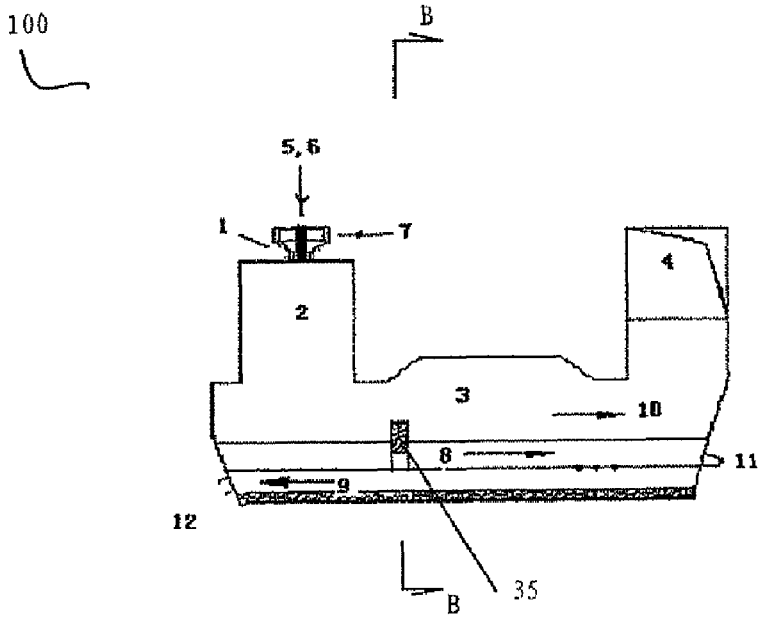
FIG. 1 is a schematic view of a swirling column smelting equipment according to an embodiment of the present invention.

Reference will be made in detail to example embodiments of the present invention. The same or similar elements and the elements having same or similar functions are denoted by like reference numerals throughout the descriptions. The example embodiments described herein with reference to drawings are explanatory, illustrative, and used to generally understand the present invention. The example embodiments shall not be construed to limit the present invention.

The following will describe the smelting method according to example embodiments of the present invention. During the metallurgical smelting process of lead concentrate, the reaction speed is determined by the effects of heat conduction and transmission between gas phase, liquid phase and solid phase. Therefore, to obtain rapid and complete reaction, the material has to be suspended adequately in the reaction gas. Thus, powdered lead concentrate may be used for lead smelting in the present invention.

Swirling column smelting means that ore materials are fed into the reaction shaft and are smelted in a swiringly suspended state by external heat or reaction heat. Swirling column smelting method is based on autogenous smelting. That is to say, the reaction heat from sulfide oxidation in the lead concentrate is used for smelting. It should be noted that additional heat may need to be provided based on the oxidation amount of the sulfide to in order to satisfy the heat requirement for the smelting process.

It should also be noted that, in the following, lead concentrate, which may be lead sulfide concentrate, is used as an example in describing a nozzle, equipment and a method relating to the swirling column smelting in the present invention. However, the description thereof is only for illustration purpose rather than for limitation. A person ordinarily skilled in the art can apply the nozzle, equipment and method of the present invention to other metallurgical process after reading disclosure of the present invention.

In the following, a swirling column smelting equipment 100 according to an example embodiment of the present invention will be described with reference to FIG. 1, which is a schematic view of a swirling column smelting equipment according to an example embodiment of the present invention. The swirling column smelting equipment 100 comprises a reaction shaft 2, a swirling column nozzle 1 disposed on a top of the reaction shaft, a settling bath 3 disposed under the reaction shaft 2 for receiving melts fallen from the reaction shaft 2, and an uptake shaft 4 communicated with the reaction shaft 2 and the settling bath 3 for discharging flue gases 10 in the reaction shaft 2. It should be noted that the number of the swirling column nozzle 1 and the uptake shaft 4 may be one, or multiple to enhance lead smelting efficiency.

Figure 2:
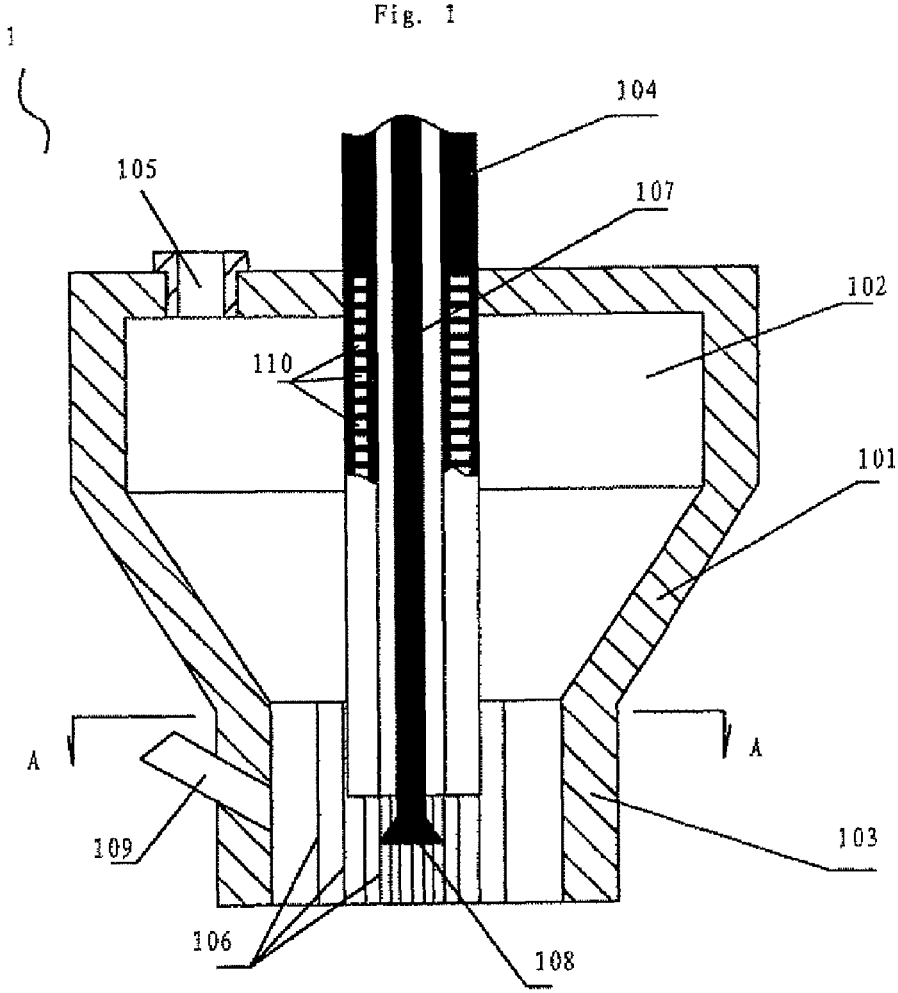
FIG. 2 is a schematic view of a swirling column nozzle according to an embodiment of the invention.
Figure 3:
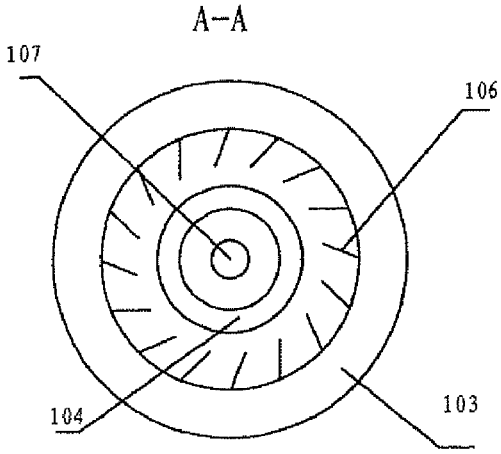
FIG. 3 is a sectional view of the swirling column nozzle according to an embodiment of the invention along A-A in FIG. 2.

The following will describe the detailed structure of a swirling column nozzle 1 according to an example embodiment of the present invention. FIG. 2 is a schematic view of a swirling column nozzle according to an example embodiment of the invention. FIG. 3 is a sectional view of the swirling column nozzle along line A-A in FIG. 2 according to an example embodiment of the present invention.

As shown in FIG. 2, the swirling column nozzle 1 according to an example embodiment of the present invention comprises a nozzle body 101 with an air chamber 102 defined therein and an outlet portion 103 connected to a lower end of the nozzle body 101, a feed pipe 104 penetrating through the air chamber 102 and extending to the outlet portion 103 for providing concentrate, such as lead sulfide concentrate, an oxygen supplying portion 105 disposed on the nozzle body 101 for supplying oxygen gas into the air chamber 102. A swirling guide part 106 is formed in the outlet portion 103, as shown in FIG. 3, for moving the mixture of the oxygen gas and the concentrate such as lead concentrate, downwardly with a swirling motion. At the swirling guide part 106, the falling concentrate and the oxygen gas in the air chamber 102 are mixed sufficiently at the outlet portion 103, and because of the swirling guide part 106, the mixture of the concentrate and the oxygen gas may be in a form a swirling column in the reaction shaft 2.

The oxygen supplying part 105 may be formed as an oxygen supplying port on the nozzle body 101, so that an oxygen gas supplying device can be connected to the oxygen supplying part 105 to supply oxygen gas for later reaction. It should be noted that, disposing of the oxygen supplying port can be modified according to process requirements without limitation to the manner and position as shown in the accompanying figures in the present invention.

In addition, the outlet portion 103 may be formed separately from the nozzle body 101. Thus, when the outlet portion 103 is damaged, a new outlet portion 103 may be substituted accordingly to decrease production cost. Of course, in the case that the outlet portion 103 is damaged, a new swirling column nozzle may also be substituted accordingly.

In an example embodiment of the present invention, the swirling guide part may be guide ribs 106 formed on the inner wall of the outlet portion 103, and the guide ribs 106 may form with a predetermined inclination angle with respect to the inner wall of the outlet portion. According to an aspect of the present invention, inclining side edges of the guide ribs in a longitudinal cross-section direction have a straight line shape or curved line shape. The curved line may be an arc, a spiral line or an involute line. That is to say, a plurality of inclined guide ribs with certain heights and lengths are provided at the inner side of the outlet portion 103 in the swirling column nozzle 1, so that the mixture of the concentrate and the oxygen gas moving vertically downward may have a certain degree of rotation.

Figure 4A:
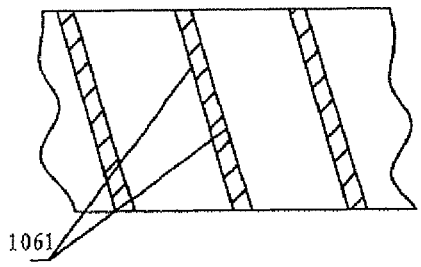
FIGS. 4A, 4B are partial exploded views along a circumferential direction of an outlet portion of the swirling column nozzle, in which the cross section of the guide ribs are shown.
Figure 4B:
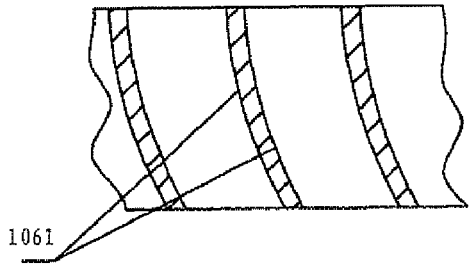

The following will describe the guide ribs 106 according to example embodiments of the present invention with reference to FIG. 4. FIGS. 4A and 4B are partial exploded views along a longitudinal and circumferential direction of an outlet portion 103 of the swirling column nozzle 1, in which the longitudinal cross-section of the guide ribs are shown. In FIG. 4A, the inclining side edge 1061 in the cross section of the guide rib has a straight line shape. The line may form a predetermined angle with respect to the bottom of the outlet portion 103 or with respect to the central axis of the outlet portion 103. Alternatively, the inclining side edge 1061 in the cross section of the guide ribs may also be curved line type, as shown in FIG. 4B. According to an example embodiment of the present invention, the curved line may be an arc line, a spiral line or an involute line. Further, the curved line may be any other line type, as long as the guide ribs can help the mixture to have a swirling motion. Thus, the mixture of the concentrate and the oxygen gas falling vertically downward with high speed may rotate to a certain extent, and form a swirling column during the downward movement in the reaction shaft 2.

Further, according to another example embodiment of the present invention, each of the guide ribs may be formed with a certain angle, height and length, which may be varied within certain ranges, respectively. The number of the guide ribs may also be varied as required. As a result, the rotating strands of the mixture in the reaction shaft may be varied, the residence time and travel distance of the concentrate during chemical reaction may be lengthened accordingly.

Still further, according to an example embodiment of the present invention, the guide ribs may be formed into straight ribs which are inclinedly disposed, or the guide ribs are formed with involute configurations. It should be noted that the guide ribs can be formed to facilitate the mixture of concentrate and the oxygen gas to be moved downwardly in a swirling motion and thus may be in the form of a swirling column. Therefore, the structures of the ribs above are used just for illustration purpose rather than limitation.

Because the mixture of the lead concentrate and the oxygen gas moves downwardly in the form of a substantially swirling column, the chemical reaction path may be remarkably extended and, subsequently, the reaction time thereof may be remarkably extended accordingly.

Further, compared with conventional bath-smelting methods, in the swirling column nozzle 1 according to an example embodiment of the present invention, the air blowing pressure of a blower beside the nozzle 1 may only reach 5-20 kPa, which is approximately 1/10 of the air blowing pressure in the conventional bath-smelting method. Thus, energy consumption of the blower may be reduced by ninety percent.

In addition, the feed pipe 104 may further supply auxiliary fuel, such as diesel oil or core powder etc. In light of the grade of the lead concentrate, especially the S, Fe contents contained in the concentrate, during the reaction process of the lead concentrate with the oxygen gas, additional auxiliary fuel may have to be supplied into the mixture of the lead concentrate and the oxygen gas to provide required additional heat due to the heat loss through the wall of the reaction shaft 2. In addition, a mixing member 107 may be further provided in the feed pipe 104 for sufficiently mixing the concentrate and the oxygen gas.

According to an example embodiment of the present invention, a cone-shaped mixing member 107 for sufficiently mixing the concentrate and the oxygen gas may be further provided in the feed pipe 104. According to an example embodiment of the present invention, the mixing member 107 is an elongated pipe inserted into the feed pipe 104 with a lower end being formed with a cone-shaped part 108 so that the falling lead sulfide concentrate is scattered by the cone-shaped part 108 to sufficiently mix the oxygen gas with other auxiliary fuel.

To monitor the mixing of the lead concentrate and the oxygen gas in the nozzle 1 or clean the accumulated mine scales in the swirling column nozzle, a check port 109 facing directly toward the lower end of the feed pipe 104 may be formed on the side wall of the outlet portion 103. Under normal conditions, the check port 109 is closed. In the case that it is needed for checking the nozzle, the check port 109 is opened for convenient maintenance.

Further, to enhance the mixing degree of the lead concentrate and the oxygen gas supplied through the oxygen supplying part 105, the feed pipe 104 may be formed with apertures 110 at the portion of the feed pipe in the air chamber 102, so that the oxygen gas can enter into the air chamber 102 through the apertures 110 to be pre-mixed with the concentrate when the lead concentrate is supplied.

It should be noted that the swirling column nozzle 1 is disposed at the top of the reaction shaft 2, as shown in FIG. 1. According to an example embodiment of the present invention, the swirling column nozzle 1 may be disposed at the center of the top portion of the reaction shaft 2 so that the mixture of the concentrate and the oxygen gas supplied by the swirling column nozzle 1 may form a central swirling column in the reaction shaft 2 and maintains a similar distance from the circumferential wall of the reaction shaft 2 thus ameliorating the erosion and scouring to the side wall of the reaction shaft 2.

With the swirling column smelting equipment 100 according to an example embodiment of the present invention with reference to FIG. 1, because the above described swirling column nozzle 1 is used, the mixture of the lead concentrate and the oxygen gas moves downwardly in a swirling track, so that the chemical reaction path and reaction time of the mixture are lengthened. Thus, additional advantages may be achieved. That is, the height of the reaction shaft 2 necessary for chemical reaction may be shortened. Further, because the height of the reaction shaft 2 is lowered, the heat loss through the wall of the reaction shaft may be reduced greatly. In addition, the construction cost may be reduced accordingly.

Further, because the mixture of the concentrate, such as lead concentrate, and the oxygen gas moves downwardly in the form of a substantially swirling column, the impact of the particles thereof to the side walls of the reaction shaft may be ameliorated, and the mixture forms a predetermined swirling column shaped reaction zone in an radial direction of the reaction shaft 2 so that there are particle gradient, oxygen density gradient and temperature gradient formed between the swirling column shaped reaction zone with high temperature generated in the reaction shaft 2 of the swirling column smelting equipment and the side walls of the reaction shaft, thus greatly ameliorating erosion and scouring of the particles with high temperature and gas to the shaft wall, and thus the shaft wall may achieve excellent protection and reduce later maintenance cost accordingly.

According to an example embodiment of the present invention, the cross section of the reaction shaft 2 has a circular shape. It should be noted that the cross section of the reaction shaft may be of any other shapes, such as square shape, which is normally adopted by the reaction shaft.

Before the lead concentrate is supplied into the reaction shaft 2 via the swirling column nozzle 1, the lead concentrate has to be dried, and in an example embodiment of the present invention, the water content in the lead concentrate may be confined to 0.5% or below. It should be noted that the lead concentrate may need to be dried to a certain extent, otherwise the smelting reaction may not be complete. The following will describe the chemical reaction in the reaction shaft 2 after the lead concentrate, the oxygen gas, and other possible auxiliary fuel are mixed.

In a reaction shaft with temperature up to 1200-1400° C., the main chemical reactions between the mixed lead concentrate and the oxygen gas are as follows:

$$PbS+O_2 \rightarrow Pb+SO_2\uparrow \quad (1)$$

$$2PbS+3O_2 \rightarrow 2PbO+2SO_2\uparrow \quad (2)$$

$$2PbO+PbS \rightarrow 3Pb+SO_2\uparrow \quad (3)$$

$$2PbO+C \rightarrow 2Pb+CO_2\uparrow \quad (4)$$

In the reaction shaft 2, the dried powdered lead sulfide concentrate and the oxygen gas are suspended and are ejected into the reaction shaft 2 with high temperature through the swirling column nozzle 1. Due to the high specific surface area of the concentrate particles during melting, a favorable chemical dynamic is formed so that the whole chemical reaction is strengthened and the main smelting process may be finished immediately.

Thus, because the mixture of lead concentrate and the oxygen gas are sufficiently mixed and starts burning immediately after it is fed into the reaction shaft 2 during the melting process of the lead concentrate, the sintering process of conventional lead sulfide concentrate is not necessary, that is, the lead sulfide concentrate may not need to be sintered, while large amounts of revert is not needed, thus enhancing production efficiency.

Meanwhile, a part of the lead sulfide reacts according to chemical equation (2) to produce lead oxide that is entrained in the slag. Therefore, it may be needed for a further reduction processing based on the chemical equation (4) for reducing the lead content in the slag as large as possible.

In addition, the residual lead oxide in the slag undertake reciprocal reaction with the fed sulfidizer (such as the lead sulfide concentrate) to further reduce the lead content in the slag. The continuously produced pig lead and the slag with lower lead content may be discharged respectively after stratification, which will be described in detail.

Figure 5:
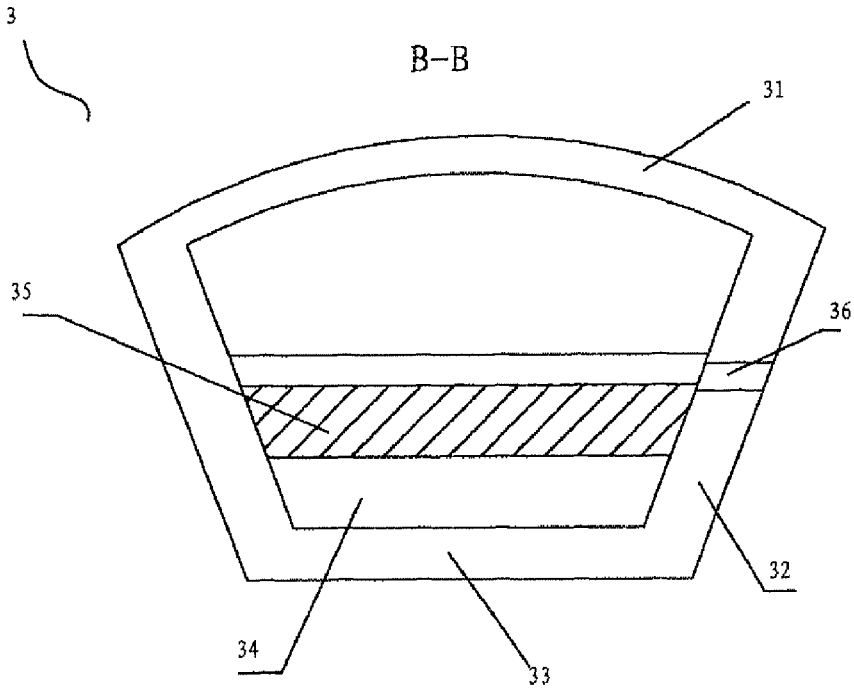
FIG. 5 is a schematic cross-sectional view along B-B in FIG. 1 of a settling bath according to an embodiment of the present invention.

The following will describe the configuration of a settling bath 3 according to an example embodiment of the present invention with reference to FIG. 5, which is a schematic cross-sectional view along B-B in FIG. 1.

The settling bath 3 has an arched top part 31, a side wall 32 connected with the arched top part 31 and a bottom part 33 connected with the side wall 32. The falling melts after reaction in the reaction shaft 2 are received in the settling bath 3. Further, there is a partitioning member 35 being disposed in the settling bath 3 in the swirling column smelting equipment 100 for partitioning the settling bath 3 into a first tank portion and a second tank portion which are communicated with each other through an opening 34 at a lower portion of the partitioning member 35. According to an example embodiment of the present invention, the partitioning member 35 may be a partitioning wall. It should be noted that any known partitioning member that can partition the settling bath 3 into two halves can be used, so that the physical room in the settling bath can be separated into two reaction rooms for further processing which will be described in detail as following.

The settling bath 3 may be further provided with a reductant supplying device 36 for feeding reductant into the settling bath so that the lead oxide in the melts of the settling bath may be further reduced to pig lead and slag with lower lead content by reduction reaction using the reductant. Lump reductant is fed into the first tank portion, and the reductant supplying device in the second tank portion may be a reductant ejector 36 disposed on a side wall of the settling bath. According to an example embodiment of the present invention, the reductant may be a lump coke and coal powder as process may require. In the case that other concentrate may be smelted, the reductant may be liquefied petroleum gas (LPG) or ammonia gas.

According to an example embodiment of the present invention, there may occur oxidation reaction between the concentrate and the oxygen gas in the reaction shaft 2, such as the reactions as defined by equations (1)-(3). In the case that the concentrate is lead concentrate, after the melts are stratified into slag layer and the pig lead layer in the settling bath 3, the swirling column smelting equipment 100 may be further provided with a sulfidizer supply device (not shown) by which sulfidizer is fed into the reaction shaft 2 or settling bath 3. The reductant, sulfidizer and the residual lead oxide in the slag layer further undertake reduction reaction and reciprocal reaction to produce pig lead and slag with relatively lower lead content.

According to another example embodiment of the present invention, one or more reducing electrodes (not shown) may be further inserted into the second tank portion of the settling bath when necessary. The reducing electrode may be a carbon electrode for example. Thus, when electrified, the carbon electrode and the lead oxide in the slag layer undergo reduction reaction.

It should be noted that there may occur oxidization reaction in the second tank portion when a different concentrate, for example copper concentrate, is smelted. When copper is melted using the swirling column smelting equipment 100 according to the present invention, after the melts are stratified into the slag layer and the copper matte layer in the settling bath 2, the oxidant such as the oxygen gas is fed into the copper matte layer, so that crude copper is obtained with the oxidation reaction. The settling bath may be further provided with oxidant supply device for supplying oxidant such as oxygen gas into the second tank portion.

In the above described example embodiment of the present invention, the pig lead production of the lead concentrate and the de-leading process of the slag may be processed in one swirling column smelting equipment, so that the whole process may be shortened, and the operation may be continuous, thus may enhancing the lead production yield and the operation efficiency of the equipment 100.

Further, the lead content in the slag of conventional process may reach 10%, thus the lead slag may have to be transported to another electric furnace for further slag cleaning to reduce the lead content thereof accordingly. However, in the present invention, because the swirling column smelting equipment according to example embodiments of the present invention is used and the carbon reductant and sulfidizer may be fed into the same equipment, the lead content in the furnace slag may be lowered to 5% or below, thus may shortening the process flow, decreasing energy consumption and production cost. After the slag is reduced in the settling bath, the slag may be discharged directly.

In addition, a lead discharging port 12, and a slag discharging port 11 are provided at the bottom of the settling bath 2 in which the slag discharging port 12 is located higher than the lead discharging port 11, since the density of the pig lead is larger than that of the slag. After the melts stay and stratify in the settling bath 2, a pig lead layer and a slag layer floating over the pig lead layer are formed.

Flue gases produced after the lead concentrate reacts with the oxygen gas passes into waste heat boiler (not shown) through the uptake shaft 4. In addition to $SO_2$ and other gases produced by burning in the flue gases, residual lead content with lower content is remained in the flue gases. Because the evaporation gas has high pressure, most of them are present in gas phases. The waste heat boiler may be formed of a radiation section and a convection section. The flue gases first enter into the radiation section which may be an empty chamber with pipes laid along walls of the chamber, and the flue gases may be cooled to around 700° C. rapidly. Then the processed flue gases enter into the convection section which is composed of pipe bundle. The flue gases are further cooled therein, for example to 300~350° C., after passing the convection section. The flue gases in the radiation section are cleaned by air or steam spraying gun. Finally, the cooled flue gases may be further processed by an electrostatic cleaner.

Further, the reaction shaft 2, the settling bath 3 and the uptake shaft 4 may be integrally formed. Thus the whole processing may be completely sealed, and the operation thereof may be safe, and the heat losses may be reduced. In addition, the reaction shaft 1 provided with the nozzle 5, the settling bath 2 and the uptake shaft 6 may also form a sealed room. Thus, the main body of the swirling column smelting equipment according to an example embodiment of the present invention is sealed, thus the flue gases may not be leaked, and low-level pollution of sulfide oxide and dust may be achieved. In addition, the integrally formed structure may have the advantage of low level of replacement of components, thus the whole equipment may have a low maintenance cost, and the working conditions for operators may be improved.

From above, the present invention may overcome the shortcomings of conventional device, and may also provide an energy-saving, environment amicable, resource-saving and safely advanced rapid metallurgical equipment. The following will describe a swirling column smelting method according to an example embodiment of the present invention with reference to FIG. 6. It should be noted, for illustration purpose only, the following will use lead concentrate as an example embodiment of the concentrate to describe the swirling column smelting method according to example embodiments of the present invention. However, a person ordinarily skilled in the art can obviously use the method thereof to smelt other concentrate such as copper concentrate.

The swirling column smelting method according to the example embodiments of the present invention comprises the following steps: mixing dried lead concentrate and oxygen gas and ejecting a mixture thereof into the reaction shaft 2 in the form of a substantially swirling column; and maintaining the temperature of the reaction shaft 2 so that the mixed lead concentrate and the oxygen gas are moved downwardly in the reaction shaft 2 in the swirling column while reacting with each other to produce melts and flue gases.

According to the swirling column smelting method of the present invention, the mixture of the concentrate, such as lead concentrate, and the oxygen gas moves downwardly in the form of a swirling column, the chemical reaction path may be remarkably extended and, subsequently, the reaction time thereof may be remarkably extended accordingly, which may further reduce heat loss and factory initial investment. In addition, the impact of the particles in the mixture to the side walls of the reaction shaft may be ameliorated, thus alleviating the severe erosion and scouring of the particles in the mixture of the concentrate and the oxygen gas to the inner walls of the reaction shaft. From above, the later maintenance cost may be reduced greatly.

The following will describe the swirling column smelting method according to an example embodiment of the present invention with lead sulfide concentrate as an example of the concentrate. To exemplarily describe the swirling column smelting method according to the present invention, the lead concentrate with the following contents is used:

Pb 40~60%; S 15~20%; Zn 3~8%; Cu 0.2~0.8%; and Fe 10~20%

The lead sulfide concentrate has water content of 8% before drying. After drying, the water content does not exceed 0.5%.

Firstly, before the lead concentrate is fed into the reaction shaft 2 through the swirling column nozzle 1, the lead concentrate has to be dried in a drying device such as steam drying machine so that the water content thereof is controlled to be lower than 0.5%. It should be noted that the lead concentrate has to be dried, otherwise the smelting will not complete.

Secondly, the dried powdered lead sulfide concentrate and the oxygen gas are ejected into the reaction shaft 2 with high temperature in the swirling column smelting equipment 100 through the swirling column nozzle 1 and float therein. Due to the high specific surface area of the concentrate particles during melting, a favorable chemical dynamic is formed so that the whole chemical reaction may be strengthened and the main smelting process may be finished immediately. The produced melts fall in the settling bath 3 at the lower part of the reaction shaft 2.

In the reaction shaft 2 with temperature as high as 1200-1400° C., the powdered lead sulfide concentrate and the oxygen gas move downwardly in a substantially swirling column. The lead sulfide is oxidized at a certain level, with the produced melts falling in the settling bath 3 below the reaction shaft 2. According to an example embodiment of the present invention, the supply of the oxygen gas may be controlled to control the oxidizing rate of the lead concentrate to remain partial lead sulfide to undergo reciprocal reaction with the lead oxide. For example, the oxidization rate of the lead sulfide may be controlled within the range between 60% and 80%, so that the remaining lead sulfide may undergo reciprocal reaction with the lead oxide. Of course, the oxygen gas can be controlled so that the oxidization rate of the lead sulfide may be controlled in another range to satisfy specific process requirement.

Further, based on the grade of the lead concentrate, especially on the content differences of S, Fe contained therein, additional auxiliary fuel may need to be fed into the mixture of the lead concentrate and the oxygen gas to supply additional heat during the reaction process between the lead concentrate and the oxygen gas, due to the heat loss through the furnace wall of the reaction shaft 2.

Because the mixture of the lead concentrate and the oxygen gas moves downwardly in a substantially central swirling column, the mixture thereof ameliorates the impact to the side wall of the reaction shaft, and the mixture forms a predetermined annular reaction section in a radial direction of the reaction shaft 2 so that there are particle gradient, oxygen density gradient and temperature gradient formed between the swirling column shaped reaction zone with high temperature generated in the reaction shaft 2 of the swirling column smelting equipment and the side walls of the reaction shaft, thus greatly ameliorating erosion and scouring of the particles with high temperature and gas to the shaft wall, and thus the shaft wall may achieve excellent protection and reduce later maintenance cost accordingly.

Figure 6:
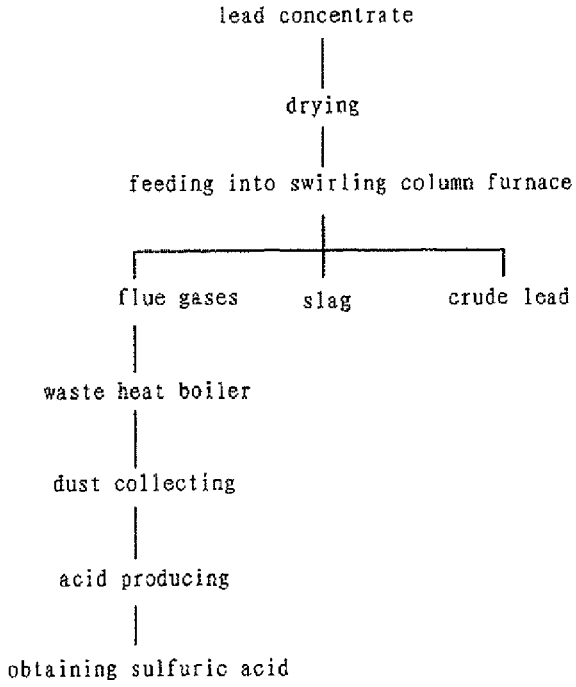
FIG. 6 is a schematic flow chart of a swirling column smelting method for lead sulfide concentrate according to an embodiment of the present invention.

According to an example embodiment of the present invention, in the case of smelting the lead concentrate, after the falling melts are stratified into a slag layer and a pig lead layer (such as stratified in the settling bath 2), carbon reductant may be fed into the melts so that the carbon reductant reacts with the lead oxide in the slag layer. The carbon reductant may have a lump shape, and the lump carbon reductant may easily react with the lead oxide in the slag layer. Thus, by the reaction between the carbon reductant and the lead oxide, sulfidizer may be further fed into the melts to undergo reciprocal reaction with the lead oxide. By the above reaction, the lead content in the slag may be lowered to 5% or below according to an example embodiment of the present invention. The slag with lower lead content may be discarded directly or further industrially processed. The produced flue gases passes to the waste heat boiler through the uptake shaft, and finally transferred to the sulfur recovery device as shown in FIG. 6.

In the above method, the cross section of the reaction shaft 2 may have a circular shape. It should be noted that the cross section of the reaction shaft 2 may have any other suitable shape as long as the cross section of the reaction shaft 2 may meet the requirement of the production.

The following will describe the application of the swirling column smelting technology used in an experimental lead smelting furnace, which can manufacture pig lead by 30,000 tons per year, by a factory in Yunnan Province, China. The contents of the lead concentrate used for the experimental lead smelting furnace are as follows:

Pb 50%; S 18%; Zn 3%; Cu 0.5%; Fe 15% and Ag 3000 g/t.

The concrete process steps are as follows:

The powdered lead sulfide concentrate with water content of 0.3% after drying and oxygen gas with wind blowing temperature of 25° C. and wind blowing oxygen content of 90% are ejected into a reaction shaft 2 with a swirling column nozzle 1 according to an embodiment of the present invention. The reaction shaft 2 has an inner diameter of 3.0 m with a height of 6.5 m. The oxygen gas is controlled so that the theoretic oxidizing rate is 67% to complete the oxidizing process of the lead sulfide, the produced melts fall into the settling bath 3 below the reaction shaft 2, and a sulfidizer supply device and a reductant supply device are provided in the settling bath.

2) Pig lead of 98% and slag are continuously produced by the reciprocal reaction and reduction reaction between the lead oxide and the lead sulfide, and Ag is concentrated in the pig lead with Ag recovery of 97%.

3) The pig lead and the slag are stratified in the settling bath 3 and discharged from the lead discharge port 4 and slag discharge port 5 with the slag having lead content of 4% which can be discharged directly.

4) There is 20% $SO_2$ in the flue gases which passes into the waste heat boiler through the uptake shaft 6, and finally the flue gases is transported into sulfur recovery device.

From the experimental results above, by using the swirling column smelting equipment and the swirling column smelting method according to example embodiments of the present invention, the pig lead producing processes are accelerated. In addition, because the mixture of the concentrate, especially lead concentrate, and the oxygen gas moves downwardly in the form of a substantially swirling column, the chemical reaction path is remarkably extended and, subsequently, the reaction time thereof is remarkably extended accordingly. Thus, the heat dissipation loss thereof can be lowered and the pre-stage investment of the plant can be reduced accordingly.

In addition, because the mixture of the concentrate, such as lead concentrate, and the oxygen gas moves downwardly in the form of a substantially swirling column, the impact of the particles in the mixture to the side walls of the reaction shaft is ameliorated, thus alleviating the severe erosion and scouring of the particles in the mixture of the concentrate and the oxygen gas to the inner walls of the reaction shaft. From above, the later maintenance cost can be reduced greatly. Further, because the pig lead production from the lead concentrate and the de-leading treatment of the furnace slaw are processed in the same swirling column smelting equipment, the whole process can be shortened with a more continuous operation, thus enhancing production yield.

Because the swirling column smelting equipment is used and the carbon reductant and sulfidizer are fed into the same equipment, the lead content in the furnace slag is lowered to 5% or below, thus shortening the process flow, decreasing energy consumption and production cost. After the slag is reduced in the settling bath, the slag can be discharged directly. Further, the reaction shaft, the settling bath and the uptake shaft can be integrally formed. Thus the whole processing is completely sealed, and the operation thereof is safe, reducing the heat losses.

The present invention has been described in an illustrative manner. It is to be understood that the terminology that has been used is intended to be in the nature of words of description rather than of limitation. Many modifications and variations of the present invention are possible in light of the above teachings. Therefore, within the scope of the appended claims, the present invention may be practiced other than as specifically described herein.

What is claimed is:

1. A swirling column nozzle, comprising:

a nozzle body with an air chamber defined therein and an outlet portion connected to a lower end of the nozzle body, wherein the outlet portion is of a hollow cylinder shape and has an outer surface and an inner surface;

a feed pipe penetrating through the air chamber and extending to the outlet portion for supplying concentrate;

an oxygen supplying portion disposed on the nozzle body for supplying oxygen into the air chamber; and a plurality of guide ribs formed on the inner surface of the outlet portion, and each of the plurality of guide ribs has a predetermined inclination angle with respect to the inner surface of the outlet portion along a longitudinal direction, such that when a mixture of the oxygen and the concentrate moves downwardly, the mixture of the oxygen and the concentrate will be guided by the plurality of guide ribs in the predetermined inclination angle with respect to the central axis of the outlet portion and thus be in a substantially swirling column form.

2. The swirling column nozzle according to claim 1, wherein auxiliary fuel is further supplied through the feed pipe.

3. The swirling column nozzle according to claim 2, wherein a cone-shaped mixing member is provided at a lower portion of the feed pipe for sufficiently mixing the concentrate and the oxygen gas.

4. The swirling column nozzle according to claim 1, wherein apertures are formed on a part of the feed pipe positioned in the air chamber.

5. The swirling column nozzle according to claim 1, wherein both inclining side edges of a cross section of each guide rib have a straight line shape or curved line shape.

6. The swirling column nozzle according to claim 1, wherein the outlet portion is separately formed.

7. A swirling column smelting equipment, comprising:

a reaction shaft;

a swirling column nozzle according to claim 1 disposed on a top of the reaction shaft;

a settling bath disposed under the reaction shaft for receiving melts fallen from the reaction shaft, and an uptake shaft communicated with the reaction shaft and the settling bath for discharging flue gases generated in the reaction shaft.

8. The swirling column smelting equipment according to claim 7, wherein the swirling column nozzle is disposed at a central portion of the top of the reaction shaft.

9. The swirling column smelting equipment according to claim 7, wherein there are provided with a plurality of uptake shafts.

10. The swirling column smelting equipment according to claim 7, wherein the reaction shaft has a cross section with a circular or rectangular shape.

11. The swirling column smelting equipment according to claim 7, further comprising:

a separator disposed in the settling bath for partitioning the settling bath into a first tank portion and a second tank portion which are communicated with each other via an opening formed at a lower part of the separator.

12. The swirling column smelting equipment according to claim 11, wherein a reductant supplying device for feeding reductant into the second tank portion is further provided in the settling bath.

13. The swirling column smelting equipment according to claim 12, wherein the reductant supply device is a reductant ejector disposed at a sidewall of the settling bath.

14. The swirling column smelting equipment according to claim 12, wherein the reductant is any one of solid reductant, liquid reductant and gas reductant.

15. The swirling column smelting equipment according to claim 12, wherein the reaction shaft, the settling bath and the uptake shaft are integrally formed.

* * * * *